United States Patent [19]

Curtis

[11] 4,236,877

[45] Dec. 2, 1980

[54] HIGHLY ACCURATE LOW VOLUME METERING PUMP

[75] Inventor: Russell R. Curtis, Westfield, Ind.

[73] Assignee: Curtis-Dyna Products Corporation, Westfield, Ind.

[21] Appl. No.: 31,049

[22] Filed: Apr. 18, 1979

Related U.S. Application Data

[62] Division of Ser. No. 892,700, Apr. 3, 1978, abandoned.

[51] Int. Cl.[3] ..... F04B 1/00; F01B 31/14

[52] U.S. Cl. ..... 417/265; 417/251; 92/13.3

[58] Field of Search ..... 417/254, 265, 268, 249; 92/13.3

[56] References Cited

U.S. PATENT DOCUMENTS 595,717 12/1897 Kane ..... 417/429 X 1,584,449 5/1926 Grutzner ..... 417/254 X

*Primary Examiner*—Richard E. Gluck

*Attorney, Agent, or Firm*—Woodard, Weikart, Emhardt & Naughton

[57] ABSTRACT

Disclosed is a dual pump with priming reservoir assembly for dispensing a fluid chemical at a low flow rate into a substance with which the fluids is to be mixed. It includes adjacent primary and secondary piston-type pumps and a separation chamber or priming reservoir. The primary pump has a discharge capacity in substantial excess of the final dispensing fluid flow rate. The suction side of this pump is connected to a remote source of chemical fluid to be dispensed. The discharge line of the primary pump and the suction side of the secondary pump communicate with the reservoir. The discharge side of the secondary pump is connected to the dispensing line and its output is adjusted to provide the desired, accurately metered dispensing fluid flow.

1 Claim, 8 Drawing Figures

HIGHLY ACCURATE LOW VOLUME METERING PUMP

This is a division, of application Ser. No. 892,700, filed Apr. 3, 1978, now abandoned.

BACKGROUND OF THE INVENTION

Various applications require the delivery of chemicals at accurately metered low flow rates. One such application is the dispensing or injecting of small amounts of drying agents into the rinse water used in commercial or institutional dish washing apparatus. In such applications the feed rate must often be adjusted down to a very low value. At such low flow rates, ability to prime is very poor. An accurate metering, low volume pump requires much time just to exhaust the air from a dry suction line. Now this time is increased by:

1. Volume of air in the suction line (length and size of line).
2. Differential air pressure required to open the check valves.
3. Height of the metering pump over the liquid source. With increasing height the small metering pump must exhaust a greater volume of air since the air is at reduced pressure.
4. Altitude which has the same effect as 3 (above).
5. Volatility of liquid, since this can require the pump to exhaust vapor as well as air.
6. Temperature of the liquid either in the container or at any area in the suction line and pump, since this always raises the volatility.

Whenever one or more of these factors are present, the small metering valve primes slowly or not at 11 resulting in failure of injection of the chemical into the host medium with attendant process failures. U.S. Pat. No. 3,680,985 discloses a prior art attempt to deal with this problem.

The apparatus of the present invention utilizes a first pump whose capacity is substantially in excess of the low flow rate of the fluid to be injected into the host medium. This larger capacity pump insures that there will be a minimum priming delay as the fluid is drawn from the remote supply. The pump discharges into a small separation chamber or priming reservoir which has an overflow line leading back to the fluid supply. A second pump, having a much smaller, but adjustable, flow rate draws fluid from this separation chamber and discharges it, to the injection line which delivers the fluid to the host medium. This separation chamber is so designed that air and vapor bubbles delivered to it rise with the excess liquid and pass thru to the overflow line so they do not adversely effect the rate of the metering pump.

DESCRIPTION OF THE PREFERRED EMBODIMENTS

Figure 1:
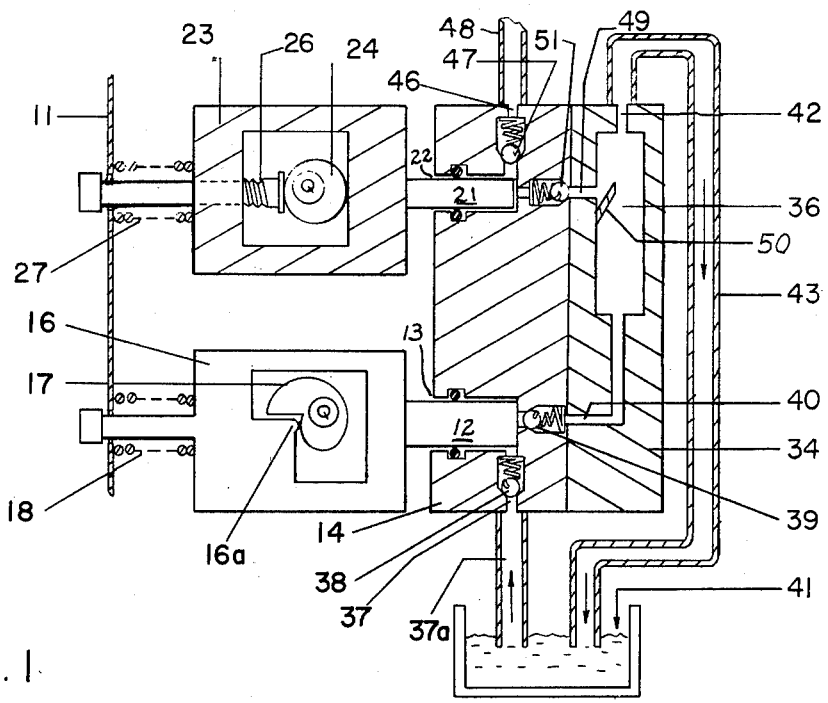
FIG. 1 is a schematic illustration of the apparatus and fluid flow path of the present invention.
Figure 2:
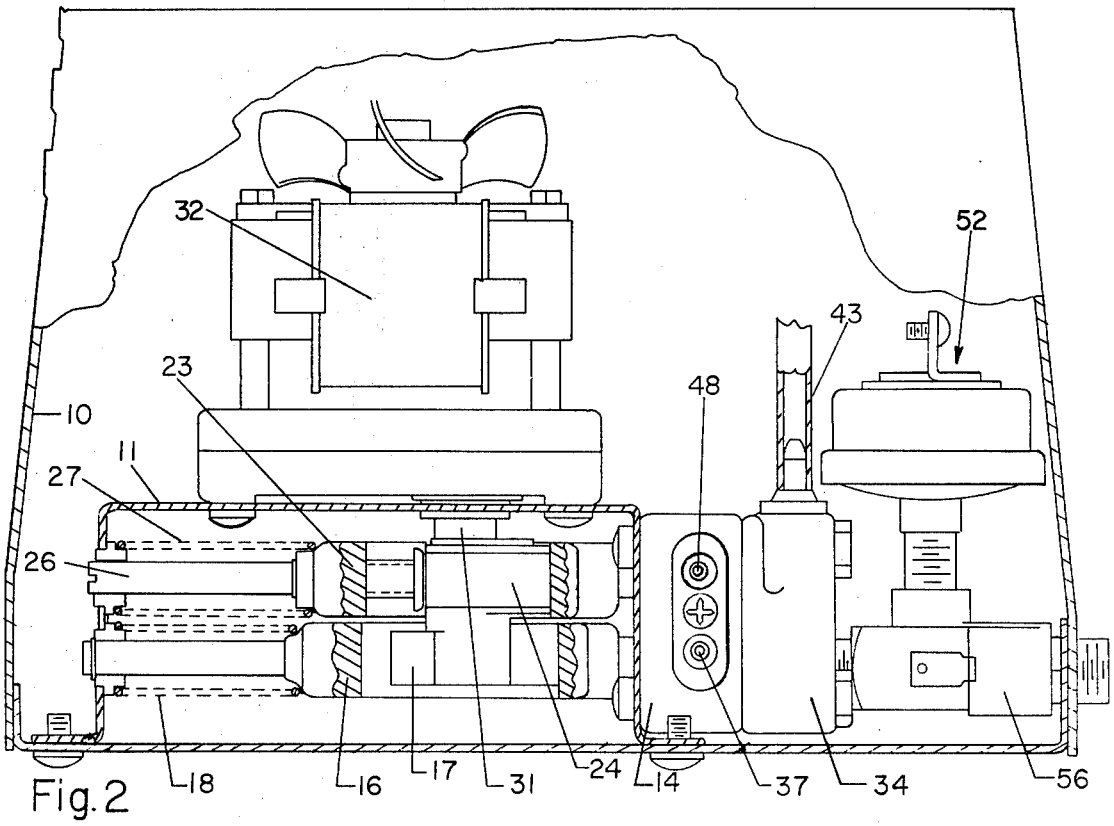
FIG. 2 is a side view, with a portion of the housing broken away, of the apparatus shown schematically in FIG. 1.

Referring initially to FIGS. 1 and 2, the pumping apparatus is enclosed in a vented housing 10 whose base carries a support bracket 11 upon which most of the assembly components are mounted. A piston 12 (FIG. 1) is mounted for reciprocation in a cavity 13 formed in a housing block 14.

The piston 12 is rigidly attached to a yoke 16 having a cam follower 16*a* (FIG. 1) which engages a cam 17, the follower 16*a* being urged against the cam periphery by the compression spring 18. The cam and follower may be of the constant torque type disclosed and claimed in Curtis et al. U.S. Pat. No. 3,768,732 and the rigid connection of the piston 12 to the yoke 16 will be apparent from FIG. 5. This cam configuration provides the best combination of slowly increasing velocity with as little disturbance as possible with discharge occuring rapidly thus providing optimum discharge valve action. This is desirable because increasing disturbance or turbulence of the liquid results in increasing the release of air into solution and more formation of vapor.

Mounted just above the piston 12 and yoke 16 is a second piston 21 which is adapted to reciprocate in a cavity 22 (FIG. 1) in the block 14. Reciprocating motion is imparted to piston 21 by means of a yoke 23 moved by rotation of a cam member or eccentrically mounted disc 24. The yoke carries a threaded shoe 26 which engages the periphery of eccentric 24 under the pressure exerted by compression spring 27. The shank of the shoe member 26 extends beyond the bracket 11 and may carry a knob, as in FIG. 1, or a screwdriver slot, as in FIGS. 2 and 5, to permit adjustment of the relation of yoke 23 to the eccentric 24 thus adjustably varying the stroke of piston 21. In the schematic illustration of FIG. 1 the cam 17 and eccentric 24 are shown on spaced rotational axes, however, as will be evident from FIGS. 2 and 5 these have coincident rotational axes and are fixed on a single vertical shaft 31 which is the output shaft of a conventional gear motor component 32 mounted above the upper face of support bracket 11.

Figure 5:
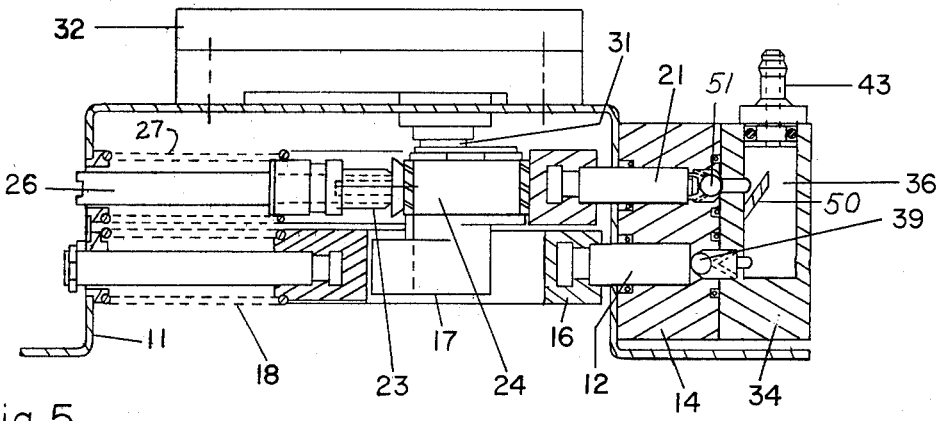
FIG. 5 is a side sectional view taken generally along the 5—5 of FIG. 4.

As may be seen in FIGS. 2 and 5, the housing block 14 has secured to it an additional block 34 which is provided with a vertically elongated cavity 36 which serves as a chamber for separating gas or vapor bubbles (inherently produced in the pumping action of piston 12) from the liquid and acts as a priming reservoir. The block 14 contains a suction passage 37, controlled by a suction valve 38, which may be of the ball-check type, the passage 37 communicating with the cavity 13 within which piston 12 moves. A discharge passage 40 in block 14 and 34 also communicates with cavity 13 and the flow through passage 40 is controlled by discharge valve 39, also of the ball-check type. The passage 40 extends into communication with chamber 36 at its lower end and the suction passage 37 communicates with a tube 37*a* which extends to a remote source 41 of fluid to be dispensed. A passage 42 (FIG. 1) in housing block 34 communicates with chamber 36 at its upper end and with a tube 43 which functions as a return line to the fluid source 41.

The block 14 contains an additional discharge passage 46, controlled by ball-check discharge valve 47, the discharge passage communicating with an injection line 48 which leads to the remote, host-fluid (not shown) into which fluid from the injection line 48 is to be metered. The blocks 14 and 34 have jointly formed in them a suction passage 49 through which a ball-check suction valve 51 controls fluid flow. The direction of fluid flow when the pump assembly is in operation is indicated by arrows in FIG. 1.

As previously mentioned, the chamber 36 functions as a gas-liquid separating chamber for releasing bubbles of air and vapor from the liquid. The larger this chamber is in volume, the lower will be the velocity of flow through it and the greater will be the escape of bubbles from the liquid surface. The drawing into suction line 49 of vapor or air bubbles by the pumping action of piston 21 is, of course, adverse to precision in metering volumetric output of the secondary pump. Protection against this is enhanced by the presence of the baffle member 50 (FIG. 1 and FIG. 2). The baffle masks or overlies the mouth of suction passage 49 in the chamber and directs the upward flow of minute bubbles in the liquid away from the mouth of passage 49.

Figure 3:
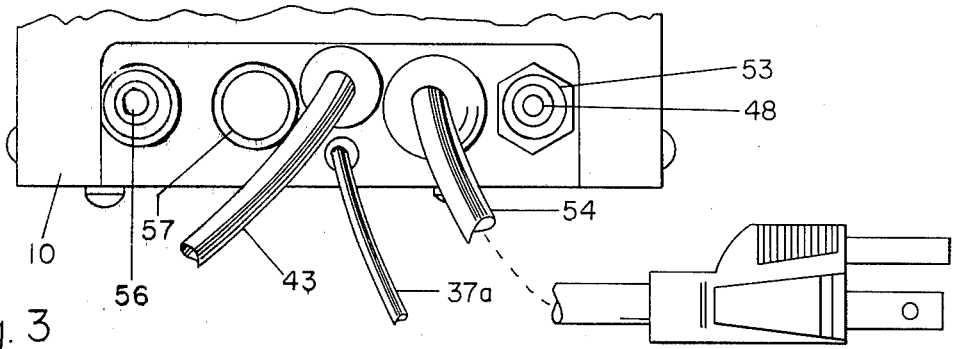
FIG. 3 is a fragmentary end view of the structure shown in FIG. 2.
Figure 4:
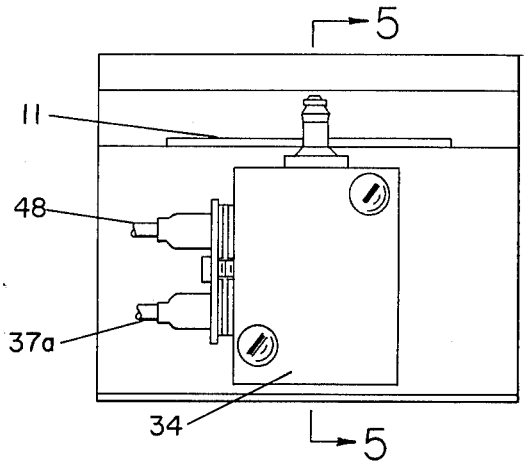
FIG. 4 is an end view of a portion of the apparatus shown in FIG. 3.

Referring to FIGS. 2 and 3, the assembly may be provided with a condition sensing means, taking the form of the conventional pressure switch 52, which controls the operation of the motor 32. A tube 53 connects the pressure switch to the conduit through which the host-fluid flows and the tube 48, through which the fluid to be injected flows, may, as indicated in FIG. 3, be concentric and extend within the larger diameter tube 53 making connection and disconnection of these lines from the pump assembly more convenient.

As may be seen in FIG. 3, an electrical cord 54, connected to the motor 32 through pressure switch 52, extends from the panel exposed by a cut-away portion of the housing 10. A three-position toggle switch 56 is mounted on the panel having an "off", "automatic" and "manual-on" positions, this last position providing for energization of motor 32 independently of the pressure switch 52. A pilot lamp 57 indicates the power-on status of the apparatus. It will be understood that these components, while useful, are not necessary for carrying out the accurate, low volume, dispensing function of the assembly.

In operaton, with electric motor 32 energized, the pistons 21 and 12 will be reciprocated and the positive displacement pump provided by motion of piston 12 will draw fluid from the source 41 and discharge it past valve 39 into reservoir 36. Piston 12 and the bore within which it moves are dimensioned so that it has a rate of discharge far in excess of the discharge rate of flow in the injection line 48. The fluid level in reservoir 36 is, therefore rapidly raised. The pump provided by the motion of piston 21 within its bore draws fluid through passage 49 from the reservoir and discharges it into the injection line 48 and this flow is injected into the host-fluid.

The stroke of piston 21 is adjusted, by means of member 26, so that the dispensing fluid flow is at precisely the desired rate. The capacity of the pumping action provided by piston 12 is relatively large so that there is a minimum of priming delay even when somewhat volatile fluids are being pumped. The flow caused by the difference in capacity of the two pumps is, as will be evident from FIG. 1, returned back to the fluid supply source 41. Spring 18 may be selected to provide the characteristics necessary to pump the particular fluid chemical to be injected. The baffle 50 minimizes the entry of air or vapor bubbles into suction passage 49.

Figure 7:
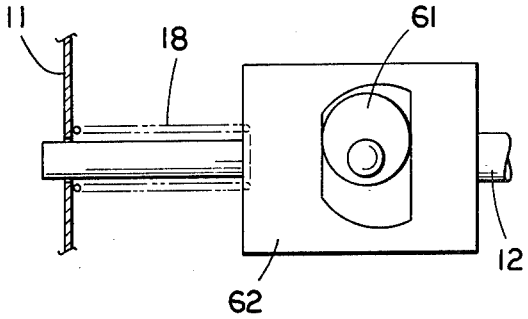
FIG. 7 is a fragmentary, schematic illustration, similar to FIG. 1, but showing the modified pump actuating means of FIG. 6.
Figure 6:
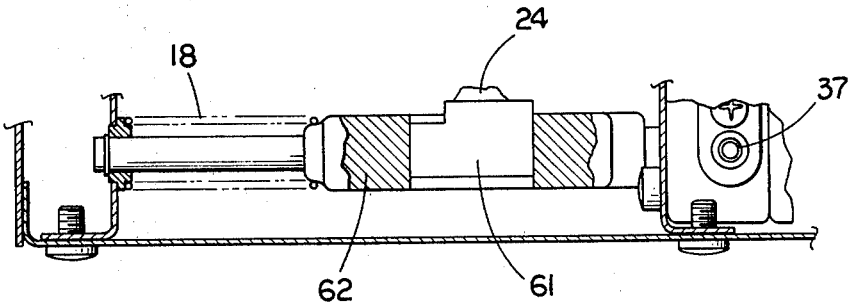
FIG. 6 is a fragmentary side view, similar to FIG. 2, but showing a modified form of one of the pump piston actuating means.

While the piston 12 has been described as being actuated by a constant torque type cam, as disclosed in U.S. Pat. No. 3,768,732, the piston might also be actuated by an eccentrically rotated disc as shown in FIGS. 6 and 7. The eccentrically mounted disc 61, replacing cam 17 on shaft 31 reciprocates the yoke 62, which replaces yoke 16. The piston 12, in this form of the device, is rigidly attached to the yoke 62. Operation of this modified form of the device is identical to that described with reference to FIGS. 1 -5.

Figure 8:
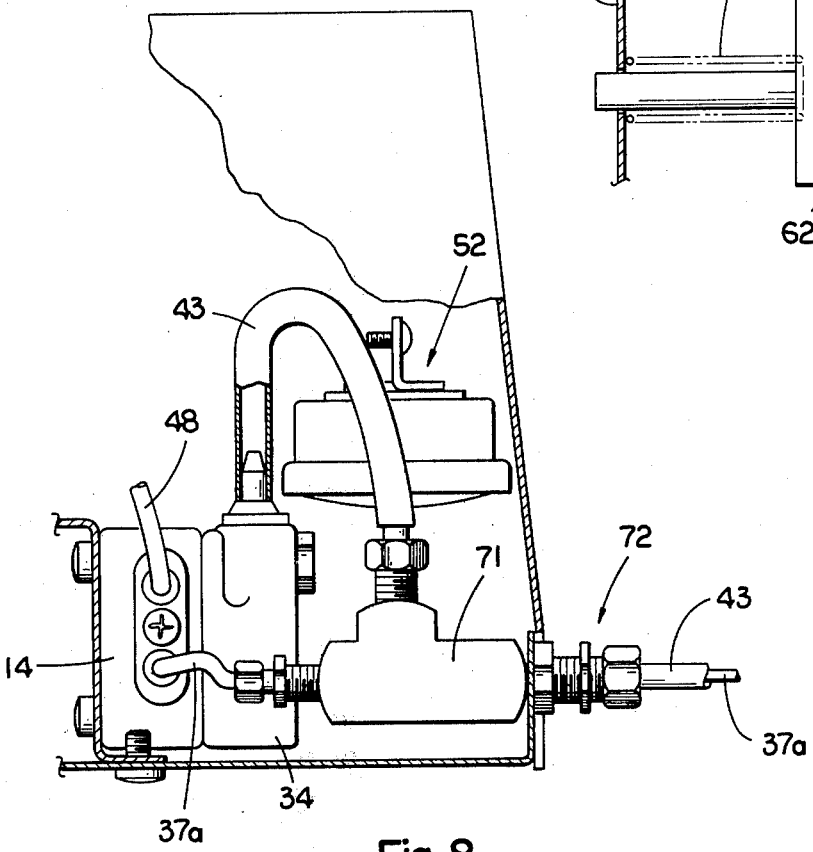
FIG. 8 is a fragmentary side view, similar to FIG. 2, but showing a modified form of arrangement of the fluid lines which extend to the remote source of fluid.

In FIG. 1 and as described with reference to FIG. 3, the tubes or conduit lines leading to the fluid source or reservoir 41 (FIG. 1) are described as separate (suction line 37*a* and return line 43). FIG. 8 shows a slightly modified form of the structure in which line 37*a*, at its connection at the housing, extends concentrically within the return line tubing 43. Flow in the two lines is maintained separate and distinct (since fluid normally flows in opposite directions therein), but in this arrangement only a single extension to the reservoir is needed. Entanglement, as can occur when two separate lines are used, is thus avoided. As may be seen in FIG. 8 the separated lines 37*a* and 43 are brought together (flow paths being maintained separate, however) in a fitting 71, the concentric, dual connection being made at 72. Intake line 37*a* may be extended to the bottom of the fluid reservoir and provided with an appropriately screened foot (not shown), while return line 43 may, of course, terminate anywhere within the reservoir.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A dual, piston-type pump assembly comprising a support bracket, two pistons supported for reciprocal parallel motion on said bracket, electrical power means and motion transmission means supported on said bracket for reciprocating said pistons, a first block supported on said bracket having two parallel vertically spaced cavities therein within which said pistons move, said cavities, each terminating in passages opening on an outer marginal surface of said block, the passage communicating with the lowermost of said cavities being check-valve controlled to form a discharge passage for the lowermost cavity, the passage communicating with the uppermost of said cavities being check-valve controlled to form a suction passage for the uppermost cavity, a second block mounted with a face thereof contiguous with said outer marginal surface of said first block, a cavity in said second block providing a gas-liquid separation chamber, and vertically spaced apertures in said second block communicatng with said chamber and registering with said passages in said first block, the passage controlling check valves for said passages to said parallel cavities being disposed at the interface of said first and second blocks for controlling the flow therein, and further check-valve controlled passages in said first block providing a suction line to the lowermost one of said piston cavities and a discharge line from the uppermost one of said piston cavities.

* * * * *